US005259230A

United States Patent [19]

Beyers

[11] Patent Number: 5,259,230

[45] Date of Patent: Nov. 9, 1993

[54] METHOD OF POSITIONING FLAT STOCK TO BE BENT

[76] Inventor: Gerald W. Beyers, 2865 Lilac La., Fargo, N. Dak. 58102

[21] Appl. No.: 963,135

[22] Filed: Oct. 19, 1992

[51] Int. Cl.[5] ..... B21D 5/04; B21D 28/04

[52] U.S. Cl. ..... 72/294; 72/319; 72/420; 72/461; 72/31

[58] Field of Search ..... 72/319-323, 72/461, 420, 389, 379.2, 324, 31, 294

[56] References Cited

U.S. PATENT DOCUMENTS

| | | | |
|---|---|---|---|
| 3,094,159 | 6/1963 | Walsh | 72/389 |
| 3,914,974 | 10/1975 | DeVore | 72/319 |
| 4,175,737 | 11/1979 | Foss | 72/461 |
| 4,365,500 | 12/1982 | Klukow | 72/319 |

FOREIGN PATENT DOCUMENTS

| | | | |
|---|---|---|---|
| 30526 | 2/1985 | Japan | 72/389 |
| 144824 | 6/1988 | Japan | 72/420 |

*Primary Examiner*—Daniel C. Crane

*Attorney, Agent, or Firm*—Hubbard, Thurman, Tucker & Harris

[57] ABSTRACT

A plurality of notches are formed in one or both ends of long pieces of sheet metal by means of a notched template and a notching tool. The notches establish the break lines on the pieces. The side edge of a sheet metal bending brake is provided with an attachment having a pointed notch receiving and locating edge intersecting the bending axis of the brake which automatically positions the stock for bending. After a bend is made on a break line, the stock is repositioned and another notch used to self-align the stock on another break line. By turning the stock over, notches in the other end can be used to position and locate a break line to perform breaks in an opposite bending direction. Labor cost is greatly reduced, waste due to improper positioning is reduced, and more accurate reproducible bends produce greater uniformity in the finished pieces.

28 Claims, 2 Drawing Sheets

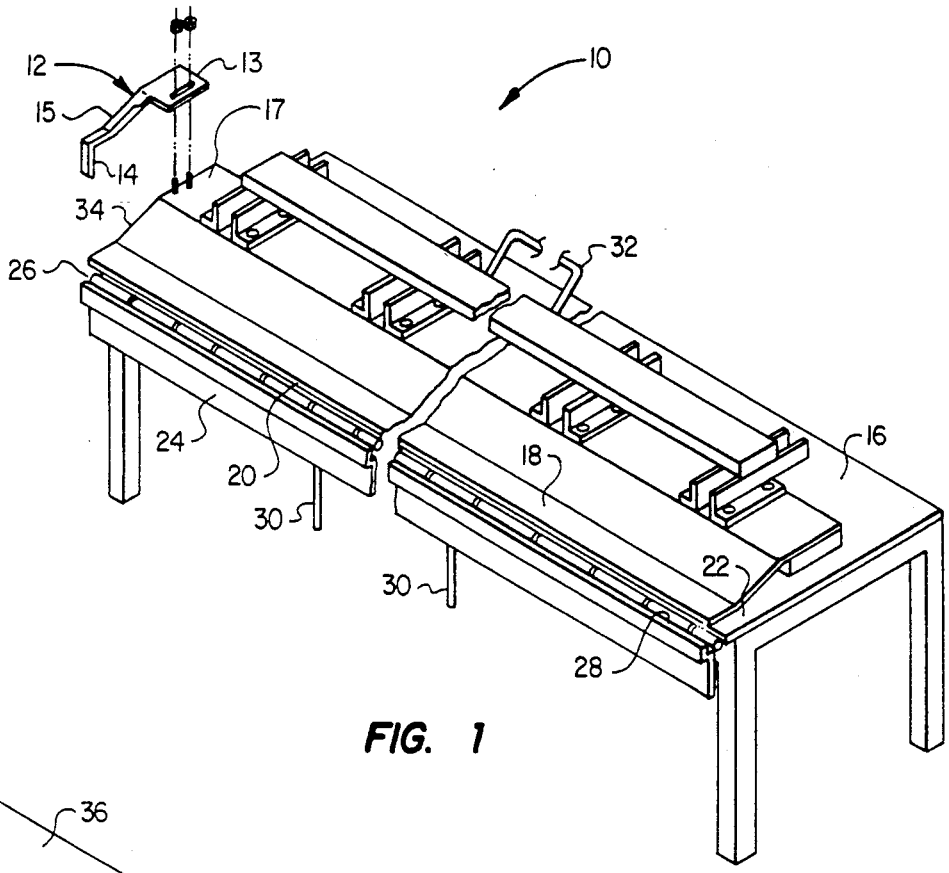
FIG. 1
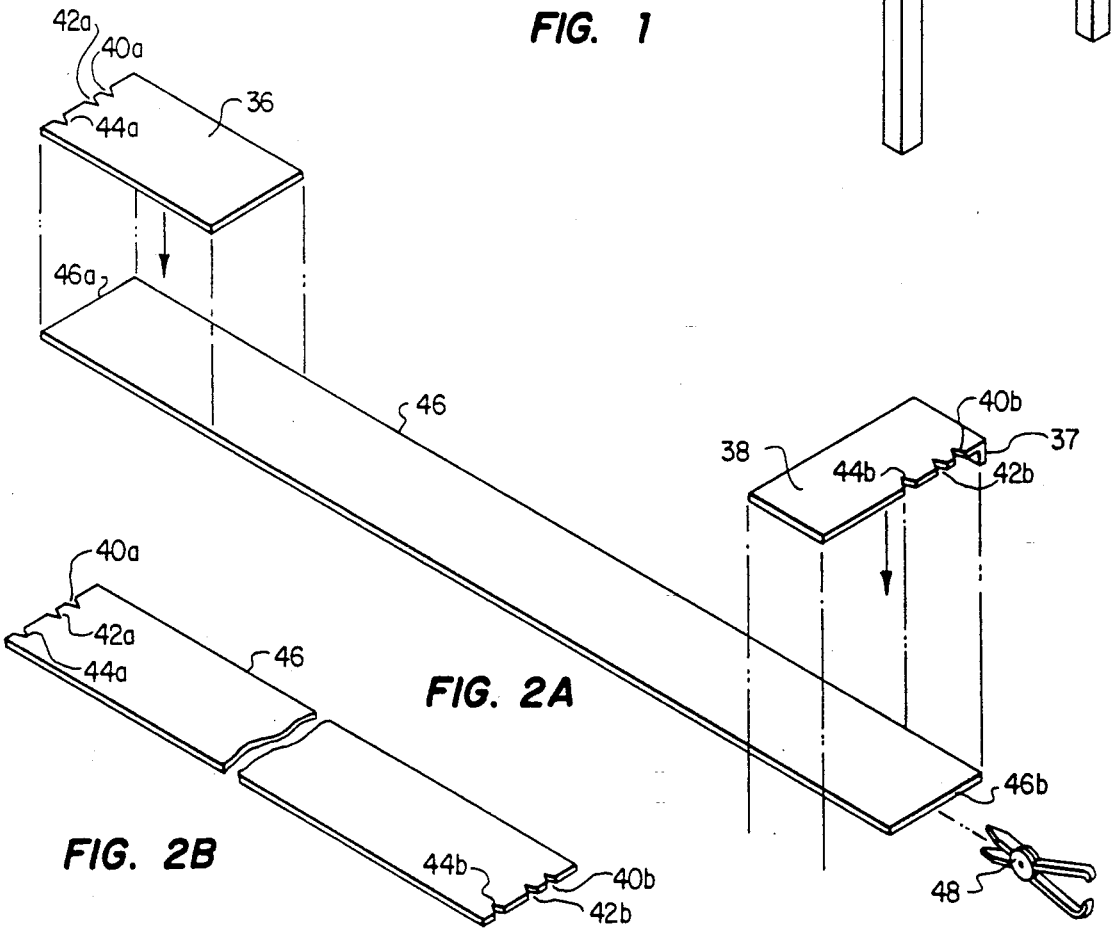
FIG. 2A
FIG. 2B

METHOD OF POSITIONING FLAT STOCK TO BE BENT

BACKGROUND OF THE INVENTION

1. Field of the Invention

The invention is in the field of rapidly and accurately producing trim for commercial building and home siding installation.

2. Background of the Prior Art

In the art of installing siding which is usually made from painted metal, such as aluminum or steel, it is necessary to provide various trim pieces around doors and windows or to cover soffit and fascia. For example, it is often desirable to cover brickmold around windows and doors. These moldings need to tie in with the rest of the siding for the sake of weather tightness and appearance.

It is most desirable to produce such trim pieces from a series of long lengths of flat stock or from coil stock which is pulled from a coil and cut to the length desired. In view of the different finishes, colors, thicknesses and type of metal and other variations, it is important to keep inventory at a minimum. Long lengths of flat stock are fabricated by bending along "break lines" parallel to one long edge to produce different cross-sectional shapes. Windows and doors to be trimmed vary considerably from job to job because of differences in architectural design and construction practices. Consequently, the trim is custom made in order to produce the best appearance and fit.

It is customary to take appropriate measurements from the structure which is to be trimmed and then mark the flat sheet stock to be bent to establish the "break lines" on the stock. By this is meant imaginary or applied lines parallel to the longitudinal edge of the stock which define the width of individual panels after the stock is bent. The finished trim often has some kind of generally "U" shape which serves to run off rain water. The stock is bent along the break lines by means of a bending break which may be hand or power operated. Once it is known where the break lines should be located, it is necessary to produce a plurality of similar pieces to use on a multiplicity of doors and windows, the pieces generally being mitered at an angle such as 45 degrees to intersect at the corners.

This necessitates repetitively and manually marking the break lines on successive flat stock pieces in order to determine the position of the break lines so that the stock can be placed in the brake and bent at the appropriate place. Manual marking is required on both ends of the stock or along the length of the stock in order to provide a positioning mark to locate the stock and the break for bending along the bending axis of the brake. In addition to being extremely time consuming, the manual marking often engenders wastage of stock caused by error. Even more significant is the time required to position the break lines of the stock on the bending axis of the brake. This operation is also difficult, fraught with error and is tedious, a combination designed to cause waste. The alignment is more difficult once several bends have been made on a piece because the operator is working with a bulky shape which obstructs vision instead of a nice flat sheet which is relatively easy to handle. The invention greatly reduces these problems and speeds up the bending process.

The use of the invention provides a method of rapidly and accurately locating pre-selected break lines on flat stock and automatically aligning one or both ends of the stock in the jaw of a bending break with a high degree of reproducibility and ease in order to reproduce the same cross-sectional shape every time in about half the time.

SUMMARY OF THE INVENTION

The invention is a method of quickly self-aligning lengths of flat stock on the break line of a bending brake apparatus in order to bend the stock along break lines which lie parallel to a longitudinal edge of the stock. Along the stock, the break line is the place where it is bent. On the brake, the break line is the place where the bend occurs just ahead of the front edge of the upper jaw. A pointed edge attachment or brake pointer is provided at the side edge of a brake with a pointed edge portion in line with and intersecting the break line or bending axis of the brake. Measurements are made on brickmolding or other structure to be covered by the trim to be made by the method. This makes it possible to provide a notched template means for locating on one end of the flat stock pieces, selective notches which correspond with desired break lines. At least one end of the flat stock is notched to correspond with selected notches on the template. The template may be turned over to notch the opposite other end of the stock to produce selected notches at both ends of the stock which are at the same selected distance from the longitudinal edge of the stock to produce pairs of notches which define the break lines on the stock to be bent. One of the stock may have the selected notches made by use of the template while the other end of the stock may be marked to indicate where the break line is located, the marks corresponding to the distance from the edge of the notches at the other end.

A selected notch is placed against the pointed edge attachment by sliding the stock sideways while the jaws of the break are open to self-align the stock on a selected break line in preparation for bending. "V" shaped notches on the stock closely fit the pointed edge portion of the attachment because the shape is the same as the shape of the notch. The opposite end of the stock is adjusted in the jaws of the brake so that the corresponding mark or notch which defines the break line is on the bending axis of the press. This is easy to accomplish from one end of the brake because the other end of the stock is securely positioned and held in position by the pointed edge attachment in contact with the "V" shaped notch during this manipulation. Then the jaws of the brake are closed and the brake is operated to produce the desired bend in the stock.

The jaws are opened and the notched end of the stock is moved in contact with another selected notch against the pointed edge attachment which defines the end of another selected break line. The opposite end of the stock is manipulated to align it in the brake, the jaws are again closed and the brake is operated to produce a second break along a second break line. The jaws may be opened and the stock repositioned on a third or succeeding notches which define third or succeeding break lines and the stock aligned in the brake with the jaws closed and the brake operated to produce third or additional successive bends on the same piece of stock.

The selected notches produced by the template at one end of the stock may define a plurality of break lines of different distances from the edge of the stock which together with corresponding notches or marks at the opposite end of the stock are all used to produce bends by successively contacting the notches in the end of the stock in preparation for bending. Bends may be made in different directions by making one or more bends utilizing one or more selected notches at one end of the stock and turning the stock over and reversing the ends to utilize another selected notch in the opposite end of the stock to make one or more bends in the opposite direction.

The stock may be notched with a plurality of notches which are used selectively to produce bends utilizing different selected notches in combination with the brake pointer to make bends at different break lines so that different cross-sectional shaped trim can be made from pieces of the same stock.

The pointed edge portion of the brake pointer which fits the notches is preferably oriented in the normal direction to the surface of the stock to bent. It is preferably mounted to a portion of the bending break which is stationary during the bending operation and bent to conform closely to the upper edge of the bending brake so as to permit the operating step to be performed without interference. A second brake pointer can be attached to the opposite side end of the brake so that both notched opposite edges of the stock can be simultaneously placed in contact with the edge portions of the opposed pointed edge attachments and automatically aligned on the bending axis without any further manipulation.

The invention includes a rapid production method for sequentially positioning a series of long lengths of flat stock along the bending axis of a bending break to form a plurality of bends at preselected distances from a longitudinal edge of the flat stock along a plurality of break lines. The series of long lengths of flat stock are prepared having opposite ends with a plurality of sets of notches which define a plurality of break lines between the notches at different distances from a longitudinal edge of the stock. A brake pointer is provided on at least one side edge of a bending break with a notch receiving and locating edge mounted at an end of the bending axis of the brake closely adjacent to the side of the brake. A selected one of the plural sets of notches of the stock on the press are positioned against the notch-receiving edge of the brake pointer and the other notch of the selected set positioned on the bending axis of the brake. The press is operated to bend the stock along the break defined between the notches of the selected sets of notches on the stock. The jaws are opened and the stock repositioned to place at least another selected one of the plural set of notches against the notch receiving edge of the brake pointer and the other notch of the other selected set on the bending axis of the brake. The press is operated again to bend the stock along the break line defined between the notches of the at least another selected set of notches. The stock is removed from the brake and additional ones of the series of long lengths of flat stock at notched opposite ends are rapidly and accurately bent along preestablished break lines by repeating the steps above which were performed on the first stock of the series. By preparing a series of notched stock by means of the templates previously mentioned, a plurality of stock can be rapidly produced having bends located accurately at the same break lines to produce multiple pieces of trim having the same cross section which will fit together neatly without variation in about half the amount of time that would be required by the conventional method.

Once the notches are made, it is virtually impossible to err in locating the stock in the bending break to reproduce that location on succeeding pieces. In addition to speeding up the work, this significantly effects the accuracy of the finished product and significantly reduces the amount of waste caused by misalignment of the stock during the bending operation. Since the siding installers are usually paid on a piece work basis rather than by the hour, use of the method to produce trim in about half the time is the equivalent of doubling their earnings. This is a very significant factor in the highly competitive siding industry.

BRIEF DESCRIPTION OF THE DRAWINGS

FIG. 1 is a perspective view showing a typical bending brake with a break pointer attachment at one end;

FIG. 2A showing how notched templates are used at each end of flat stock to create the notched end configuration of FIG. 2B;

FIG. 2B shows the flat stock having both ends with corresponding sets of notches which define break lines at varying distances from the longitudinal edge of the stock;

DETAILED DESCRIPTION OF THE INVENTION

Figure 3:
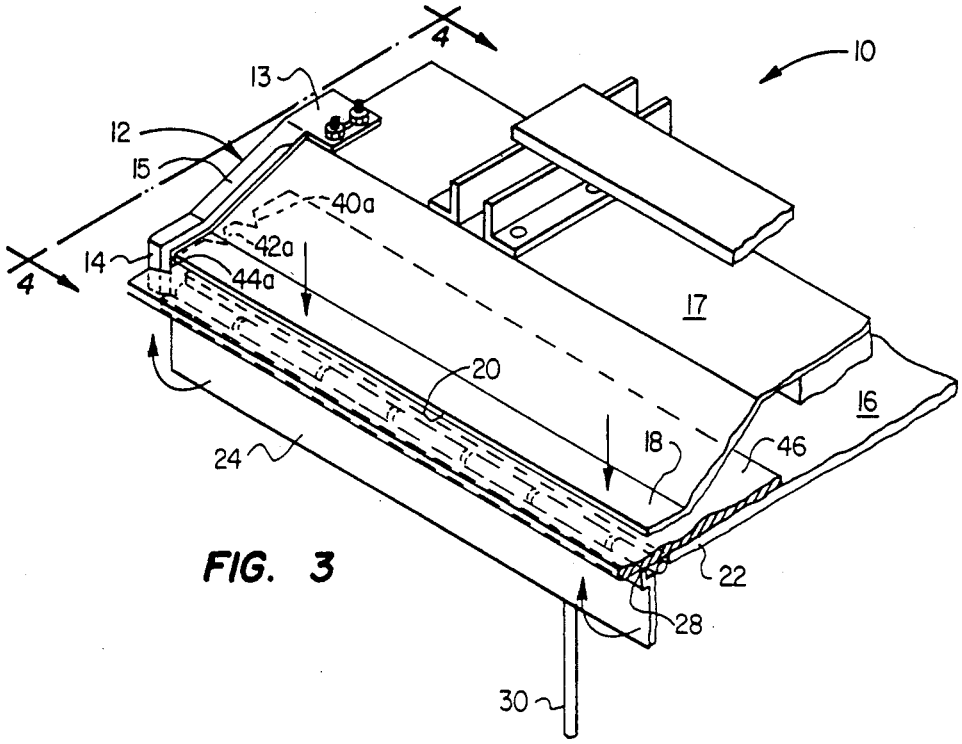
FIG. 3 shows a cut-away portion of the brake of FIG. 1 with flat stock in position for bending.

In the description that follows, like parts will carry the same reference numerals. The drawings are not necessarily to scale and are somewhat schematic in nature to illustrate the invention.

FIG. 1 is a schematic illustration of a sheet metal bending brake assembly generally designated by the reference numeral 10. Bolted along one side edge 34 of brake 10 is a pointed edge attachment 12, also referred to as a brake pointer, having a pointed "V" shaped edge 14 depending therefrom in a vertical direction. Attachment 12 has a mounting bracket portion 13 having an extension 15 which supports the "V" shaped edge portion 14. Edge attachment 12 may be bolted to a portion of upper frame 17 along side edge 34 of brake 10.

Brake assembly 10 has a supporting frame 16 which carries upper frame 17 having an upper clamping jaw 18 and a fixed lower jaw 22 which clamp together by means of clamping arm 32 to hold long lengths of sheet stock in the jaws for bending. Clamping jaw 18 has a terminal bending edge 20 running longitudinally along the outer edge thereof. Suspended by hinge pivot 26 below bending edge 20 is what is known as "hinge" 24 having manually operated hinge arms 30 which are manually pulled to rotate a bending lip 28 up against stock which is clamped in jaws 18, 22. The bending axis may be said to be coextensive with bending edge 20 and may be thought of as continued beyond either edge of clamping jaw 18. The "V" shaped pointed edge portion 14 of break pointer 12 intersects the bending axis so that a "V" shaped notch which is pushed against it is located with the point of the "V" right on the bending axis.

The invention employs one or more templates 36, 38 having a plurality of "V" shaped notches in an edge thereof. For illustration, template 36 has notches 40*a*, 42*a* and 44*a* in an edge thereof. It is simply a generally rectangular piece of sheet metal from which these notches are formed by means of notching tool 48. Template 38 illustrates a variation of template 36 wherein one or more right angle guide edges is provided along one side to assist locating the template precisely along the longitudinal side edge of stock 46. Template 38 has "V" shaped notches 40*b*, 42*b* and 44*b* which are spaced exactly the same distance from a side edge of a stock 46 as are corresponding notches 40*a*, 42*a* and 44*a* when the template is placed in operating position. A templates is placed in position at the ends of a series of lengthy flat sheet stock 46, and while it are held in place, it is a simple matter to create corresponding notches 40*a*, 42*a*, 44*a* in one end 46*a* of stock 46 and notches 40*b*, 42*b* and 44*b* in the other end 46*b* of stock 46. Alternately, the template can be used to notch one end of the stock and the other end of the stock can be marked in the usual manner with marks to define one end of the break lines.

The result is pairs of oppositely pointed "V" shaped notches 40*a*–40*b*; 42*a*–42*b*; and 44*a*–44*b* which comprise pairs or sets of opposed notches which define break lines on which stock 46 is to be bent. The break lines may be thought of by drawing lines between the points of the opposed notches 40*a*, 40*b*, for example, which produces a break line parallel to the edge of stock 46. The objective is to make bends in the stock along the break lines to produce trim having particular cross-sectional shapes after bending. While the term "break line" is most appropriate when used to describe where the stock is bent it may also be used with reference to the brake apparatus to mean where the bend is made.

In FIG. 3, brake assembly 10 is shown assembled with an edge attachment 12 bolted to the side edge with pointed "V" shaped edge portion 14 intersecting the bending edge axis 20 at right angles thereto. The vertical arrows indicate upper clamping jaw 18 has been clamped against stock 46 which is held by lower fixed jaw 22 in position for bending. In practice the fixed lower jaw 22 has a short flat jaw surface with open space behind the jaw which is supported by laterally spaced "C" shaped support members.

Prior to clamping stock 46 between jaws 18,22, stock 46 is laterally slid so that a selected one of its notches is in contact with the notch receiving edge portion 14 of the brake pointer edge attachment 12 and thereby automatically self-aligned so that one edge of the stock is located on the break line. The "V" shaped edge portion 14 in cooperation with a selected notch on the stock automatically receives and locates the edge of the stock with respect to the brake at the proper location for bending. The opposite end of the stock is then moved into or out of the brake jaws so that a corresponding mark or notch on the opposite end of the stock is also aligned along the break line. All that remains is to actuate the clamping mechanism to clamp the stock between jaws 18,22 and then hinge arm 30 can be used to pull the hinge upwardly so that lip 28 forms the stock around the break line which corresponds to bending edge 20 on the upper jaw. After the first bend is made, the jaw may be opened, the stock shifted to place another notch against the pointed edge of the brake pointer, realigned at the other end, reclamped and another bend may be formed.

Figure 4A:
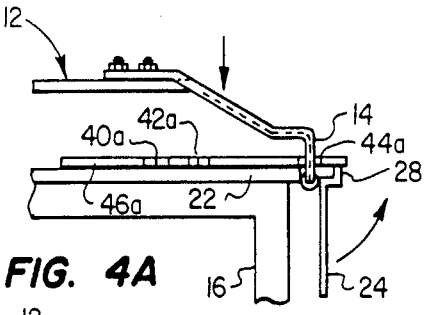
FIG. 4A shows an elevational view of one end of the brake with the first notch of the flat stock positioned against the pointed edge of the brake pointer attachment.
Figure 4B:
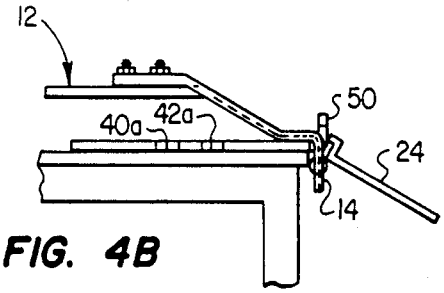
FIG. 4B shows the moving hinge of the brake being raised to make the first bend in the stock of FIG. 4A along a first break line defined by the first notch.
Figure 4C:
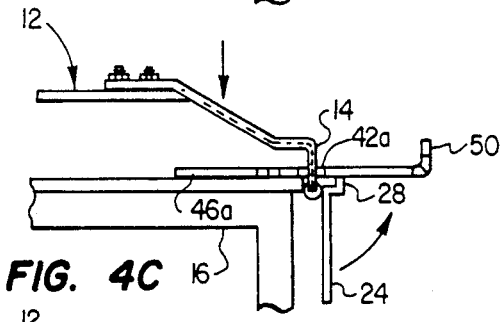
FIG. 4C shows the second notch of the stock of FIG. 1A aligned with the pointed edge of the attachment in preparation for a second bend along a second break line defined by the second notch.
Figure 4D:
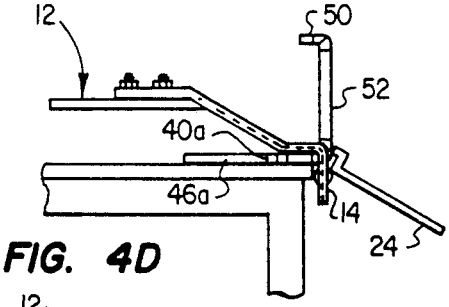
FIG. 4D shows the stock of FIG. 4C after the second bend has been made.
Figure 4E:
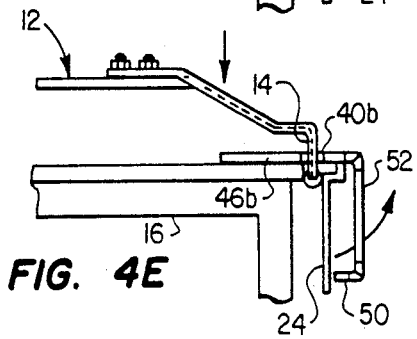
FIG. 4E shows the stock of FIG. 4D which has been turned over and reversed end for end, with a third notch positioned against the pointed edge of the brake attachment along a third break line defined by the third notch.
Figure 4F:
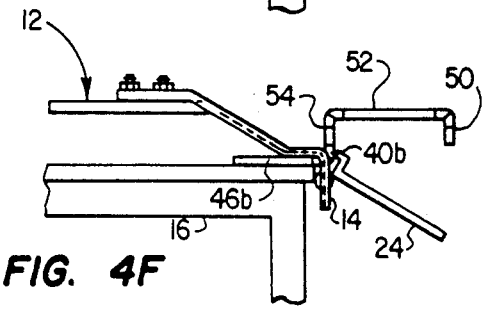
FIG. 4F shows the stock of FIG. 4E after the third bend has been made.

The sequence of forming bends is schematically illustrated in FIGS. 4A through 4F. In FIGS. 4A–F, the fixed lower jaw 22 is shown supporting the stock, but clamping jaw 18 has been removed for simplicity in illustration. It should be recognized that the longitudinal edge 20 of clamping jaw 18 would lie directly in line with "V" shaped edge portion 14 of brake pointer 12 perpendicular to the drawing sheet. FIGS. 4A, 4C and 4E show the position after the stock has been placed with a selected notch against the vertically depending "V" shaped pointed portion of the break pointer but before the jaws have been clamped on the stock. FIGS. 4B, 4D and 4F show the position after the jaws of the brake have been closed and the bend made. The break pointer attachment has moved down with upper jaw 18 because it is preferably mounted to the side of upper frame 17 which includes jaw 18. The vertically depending portion 14 is long enough to accommodate this movement while remaining in contact with the selected notch.

In FIG. 4A, the sheet of stock has been slid sideways so that a selected first notch 44*a* of end 46*a* is against the pointed edge of the attachment and the other end 46*b* is aligned with the break line 44*a*–44*b* on the bending axis of the brake.

Now by raising hinge 24 in the direction of the arrow, lip 28 of hinge 24 forces the longitudinal outer edge portion of stock 46 to bend around the bend axis 20 on the front of the upper clamping jaw. The result is seen in FIG. 4B where a first bend panel 50 has been made along the break line defined by first notch 44*a*. In FIG. 4C, the stock is now repositioned to place another selected notch 42*a* against the "V" shaped pointed edge of brake pointer 12 in preparation for the second bend. Opposite end 46*b* is aligned either by means of a mark or by notch 42*b* along the break line of the brake, the jaws are clamped and the second bend panel 52 can now be made by operating hinge 24 as shown in FIG. 4D. First and second bends 50, 52 are right angle bends with respect to the stock 46.

The advantage of notching both ends of the stock with corresponding sets of notches to define the break lines is illustrated by FIG. 4E wherein the stock 46 has been turned over and reversed end for end from the position of 4D to the position of 4E. Now the surface of the stock that was up is down, and the corresponding opposite third notch 40*b* is used to position the opposite end 46*b* of stock 46 against pointed edge 14 in order to establish one end of the break line. The other end of the break line is established by placing notch 40*a* on the break line of the brake. Now when the jaws are clamped and hinge 24 is operated, the bend panel 54 is created which is a third bend opposite to the direction of the first two bends 50, 52. That is to say the first two bends 50, 52 converge towards a surface of the stock whereas the bend at the edge of panel 54 turns away from said surface. Another way to say this is that the bends that form panels 50 and 52 are inside bends, and the bend that forms panel 54 is an outside bend. It is, of course, often necessary to make bends in both directions in order to create the desired cross-sectional shapes in various trim members.

The advantages of the inventive method are now apparent. Once the templates are marked with the desired plurality of notches along the edge in order to create a particular cross-sectional shape, it is easy to reproduce those notches in successive pieces of flat stock which have been cut to an appropriate length. No further measuring is necessary. A single template can be used at one end of the stock and by reversing the template it can produce corresponding notches at the other end of the stock which establish pairs or sets of notches which define the break lines between them. The templates may also have a plurality of notches which can be selectively used to produce several different cross-sectional shapes in the bent pieces by appropriate selection of the notches to be used during the bending operation. Although only three notches are shown in the Figures, four or more notches could be used to establish additional break lines.

Once the notches are formed in a series of flat stock pieces, the operator can quickly and accurately place selected notches in cooperation with the brake pointer to automatically position one end of the stock securely and without danger of it moving while the other end is positioned with its notch or mark on the break line. Not only do the notches serve to position the notched end of the stock when the stock is slid sideways with a notch in contact with the pointed edge 14 of brake pointer 12, the notch also serves to keep the end of the stock from sliding or moving while the other end is manipulated. This becomes even more important as successive bends are made in a piece of stock because the bent stock itself tends to obstruct the operator's visibility when attempting to align the stock in the brake. The fact that the stock has notches which extend in about ½" at the ends does not interfere with the use of the finished trim pieces because the ends are cut off to form mitered joints in order to go around windows and doors, for example.

Although it is not as flexible a process, it is within the contemplation of the invention to attach a break pointer at both opposite side edges of a brake; pointing toward the center and intersecting the bending axis. Then full lengths of stock notched on both ends could be placed into the jaws of the brake and the notches that define a break line dropped on the respective break pointers to automatically position both edges of the stock at the same time. This is a preferred method if full length stock is to be bent.

By reference to FIG. 3 and FIG. 44-A it is preferred that the break pointer attachment itself be formed to follow the edge contour of the side edge of the particular brake with which it will be used. This keeps it out of the way so as to avoid interfering with the movement of the stock during the bending operation. The particular shape of the break pointer may be varied as long as the "V" shaped edge portion is mounted to intersect the bending axis as shown. The length and positioning of the vertical pointed edge portion 14 is adapted to minimize its interference with the edges of the moving notch on the edge of the sheet as it is being bent. Some contact between portion 14 and the edges of the notch during bending can be tolerated without damaging the part since the relatively thin sheet metal on the end will easily bend out of the way and the edge is mitered off in the finished piece. The pointed edge 14 could be fabricated on a curved radius which would tend to minimize any contact with edges of the notches during the bending operation.

The sheet metal brake that is preferably employed with the method is the type of portable brake that is often carried to the job site for use with coil stock which is unwound and cut to length. A typical brake of this type may be approximately 10½ feet long. While the stock to be bent cannot be longer than the brake, the stock to be bent can be virtually any length that is less than the full width of the brake. An exemplary brake is offered by Tapco Products Co., Inc., 9240 Hubbell Avenue, Detroit, Mich. 48228, and sold under the trade name PRO-II PORT-O-BENDER. The stock to be bent is the typical painted or coated sheet metal used as siding on homes and businesses.

I claim:

1. A method of quickly self-aligning lengths of flat stock on the break line of a bending brake apparatus the bending brake apparatus having upper and lower jaws for clamping the flat stock and a bending lip for bending the clamped flat stock about the break line of the bending brake, comprising:

providing a side edge of the brake with a pointed edge attachment intersecting the break line of the break;

providing notched template means for locating on one end of the stock selected notches which correspond with desired break lines about which the stock is to be bent;

notching one end of the flat stock to correspond with selected notches on the template means;

sliding a selected notch on the one end of the stock against the pointed edge to self-align the stock within the bending brake on a break line of the stock in preparation for bending.

2. The method of claim 1 further including marking the other end of the stock opposite said one end, with marks which are the same distance from the edge as the selected notches on said one end and aligning a selected notch and a corresponding mark on the break line of the brake.

3. The method of claim 2 further including operating the brake after the stock has been aligned on the break line by means of a selected notch and a corresponding mark to bend the stock at its break line.

4. The method of claim 3 wherein the brake operating step is repeated after a first bend is made and the stock is moved with respect to the brake to a break line established by another selected notch and another corresponding mark.

5. The method of claim 1 wherein the step of providing notched template means for locating selected notches on one end of the stock includes providing template means for locating corresponding notches on one or more break lines on the other end of the stock opposite said one end, the step of sliding a selected notch on said one end against the pointed edge is accompanied by the step of aligning a corresponding selected notch on said other end with the break line of the brake in preparation for bending along a selected break line of the stock.

6. The method of claim 5 further including operating the brake in order to bend the stock along the break line defined between selected notches at opposite ends of the stock.

7. The method of claim 6 wherein the selected notches at said one and said other end of the stock comprise sets of notches to define a plurality of break lines at different distances from an edge of the stock and said brake operating step is repeated to cause bends of the stock along a plurality of its break lines.

8. The method of claim 7 wherein at least one bend is made along a break line with a selected notch of said one end of the stock in contact with the pointed edge attachment and at least one bend is made in an opposite direction with a selective notch at said other end of the stock in contact with the pointed edge attachment, by changing the end of the stock in contact with the pointed edge attachment.

9. The method of claim 7 wherein at least one bend is made toward a surface of the stock and at least another bend is made away from said surface of the stock after the stock has been turned over.

10. The method of claim 3 wherein the step of notching one end of the flat stock is repeated on a series of flat stock pieces and the step of marking includes marking the opposite other end of said series of stock opposite the end having the notches, with marks which are the same distance from the edge as the notches, wherein the brake is operated successively on succeeding ones of the series of stock after the individual ones of the series of stock have been aligned on their break lines by means of a selective notch and a corresponding mark to bend each of the series of stock pieces to establish the same cross-sectional shape.

11. The method of claim 10 wherein at least some of the first or succeeding ones of the series of flat stock pieces are bent at different selected notches and corresponding marks which define different break lines to establish at least some different cross-sectional shapes in the finished pieces.

12. The method of claim 10 wherein each of the series of long lengths of flat stock are bent to the same extent at each of the selected break lines defined by selected ones of the notches and their corresponding marks so that each of the finished pieces have identical cross-sections.

13. The method of claim 1 wherein the step of providing notches includes providing "V" shaped notches.

14. The method of claim 13 wherein the step of providing a pointed edge attachment includes providing a pointed edge attachment having a "V" shaped edge portion in line with the bending axis which fits said "V" shaped notches.

15. The method of claim 14 wherein said pointed edge portion of said attachment which fits said notches is oriented in a normal direction to the surface of the stock to be bent.

16. The method of claim 15 wherein the step of providing said pointed edge attachment includes mounting the pointed edge attachment to a portion of the bending brake which is stationary during the bending operation.

17. The method of claim 16 wherein the step of providing said pointed edge attachment includes the step of providing a pointed edge attachment which is bent to conform closely to an upper edge of the bending brake so as to permit the operating step to be performed without interference.

18. A rapid production method for sequentially positioning a series of long lengths of flat stock along the bending axis of a bending brake to form a plurality of bends at preselected distances from a longitudinal edge of the flat stock along a plurality of break lines, the bending brake having upper and lower jaws for clamping the flat stock and a bending lip for bending the clamped flat stock about a bending axis of the bending brake, comprising:

providing a series of long lengths of flat stock having opposite ends with a plurality of sets of notches at opposite ends which define a plurality of break lines between the notches at different distances from a longitudinal edge of the stock;

providing at least one side of the bending brake with a break pointer having a notch receiving and locating edge mounted at an end of the bending axis of the brake;

positioning a selected one of the plural sets of notches of the stock on the press with one notch of the set against the notch receiving edge of the break pointer and the other notch of the selected set on the bending axis of the brake;

operating the bending lip to bend the stock along the break line defined between the notches of the selected set of notches on the stock;

repositioning the stock to place at least another selected one of the plural set of notches against the notch receiving edge of the break pointer and the other notch of the another selected set on the bending axis of the brake;

operating the bending lip to bend the stock along the break line defined between the notches of the at least another selected set of notches; and removing the stock from the brake and repeating the last four preceding steps on at least an additional one of said series of long lengths of flat stock to provide stock rapidly and accurately bent along preestablished break lines.

19. The method of claim 18 wherein the first and succeeding ones of the series of flat stock are bent at the selected same corresponding sets of notches which define identical break lines to establish the same cross-sectional shape in the finished pieces.

20. The method of claim 18 wherein at least some of the first or succeeding ones of the series of flat stock are bent at different selected sets of notches which define different break lines to establish at least some different cross-sectional shapes in the finished pieces.

21. The method of claim 18 wherein each of the series of long lengths of flat stock are bent to the same extent at each of the selected break lines defined by the plurality of sets of notches so that each of the finished pieces have identical cross-sections.

22. The method of claim 18 wherein both sides of the bending brake are provided with a break pointer having a notch receiving and locating edge mounted at the ends of the bending axis of the brake and the positioning and repositioning steps include the step of positioning each notch of a set against a notch receiving and locating edge in preparation for bending.

23. The method of claim 21 wherein both sides of the bending brake are provided with a break pointer having a notch receiving edge mounted at the ends of the bending axis of the brake and the positioning and repositioning steps include the step of positioning each notch of a set against a notch receiving and locating edge in preparation for bending.

24. The method of claim 18 wherein the step of providing a series of long lengths of flat stock having a plurality of sets of notches includes providing a plurality of sets of oppositely directed "V" shaped notches.

25. The method of claim 24 wherein the step of providing a break pointer includes the step of including a notch shaped portion positioned at the bending axis of the brake which fits said "V" shaped notches.

26. The method of claim 25 wherein said plurality of sets of notches are spaced to define a plurality of break lines which can be selected in different combinations to produce differently shaped pieces bent from the same flat stock in order to reduce inventory.

27. The method of claim 25 wherein the step of providing the break pointer mounted at the side of the bending brake includes the step of mounting the brake pointer to a part of the bending brake which is stationary during the bending operation.

28. The method of claim 27 wherein the brake pointer is bent to conform closely to the upper edge of the bending brake so as to permit the operating step to be performed without interference.

* * * * *